US012291678B2

(12) United States Patent
Albenhamad et al.

(10) Patent No.: US 12,291,678 B2
(45) Date of Patent: May 6, 2025

(54) ENHANCED HYDROCARBON RECOVERY

(71) Applicant: SAUDI ARABIAN OIL COMPANY, Dhahran (SA)

(72) Inventors: Saleh A. Albenhamad, Al-Hofuf (SA); Hijji A. Alawi, Al-Hofuf (SA); Naser M. Aldossary, Al-Hofuf (SA); Hussain H. Albuhamood, Al-Hofuf (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/873,459

(22) Filed: Jul. 26, 2022

(65) Prior Publication Data

US 2024/0034940 A1 Feb. 1, 2024

(51) Int. Cl.
*C10G 33/06* (2006.01)
*C10G 31/06* (2006.01)

(52) U.S. Cl.
CPC ..... *C10G 33/06* (2013.01); *C10G 31/06* (2013.01); *C10G 2300/1003* (2013.01); *C10G 2300/1033* (2013.01); *C10G 2300/4006* (2013.01); *C10G 2300/4012* (2013.01)

(58) Field of Classification Search
CPC ..... C10G 31/06; C10G 33/00; C10G 33/06
See application file for complete search history.

(56) References Cited

U.S. PATENT DOCUMENTS

| | | | | |
|---|---|---|---|---|
| 9,828,556 | B1 * | 11/2017 | Rehm | C10G 7/00 |
| 2007/0267325 | A1 * | 11/2007 | Vu | C10G 33/00 208/187 |
| 2017/0023485 | A1 * | 1/2017 | Stubbins | C10G 75/00 |
| 2017/0073591 | A1 * | 3/2017 | Dasgupta | B01D 11/04 |
| 2020/0056107 | A1 * | 2/2020 | Iversen | C10G 1/083 |

OTHER PUBLICATIONS

S. Faramawy et al., "Natural gas origin, composition, and processing: A review", Journal of Natural Gas Science and Engineering 34 (2016), pp. 34-54 (Year: 2016).*

* cited by examiner

*Primary Examiner* — Renee Robinson
(74) *Attorney, Agent, or Firm* — Vorys, Sater, Seymour and Pease LLP

(57) ABSTRACT

Methods for treating a wet hydrocarbon sludge stream comprising separating the wet hydrocarbon sludge stream into a gaseous separation stream, a first crude product stream, and a liquid separation stream using a separation vessel. Then separating the liquid separation stream into a surge drum gas stream, a first surge drum liquid stream, and a second surge drum liquid stream using a surge drum. Then separating the second surge drum liquid stream into a stripper gaseous stream and a stripper liquid stream using a stripper system, and then separating the stripper liquid stream into an aqueous process stream and a primary crude product stream using a wet hydrocarbon separation vessel. Methods further comprising separating a blowdown stream into a blowdown gaseous stream and a blowdown liquid stream using a blowdown separation vessel and sending the blowdown liquid stream to the separation vessel.

8 Claims, 2 Drawing Sheets

ENHANCED HYDROCARBON RECOVERY

FIELD OF THE DISCLOSURE

The present disclosure relates generally to increasing refining efficiency and reducing waste and, more particularly, to recovery of usable hydrocarbons from sludge and/or blowdown feeds produced during hydrocarbon refining.

BACKGROUND OF THE DISCLOSURE

Traditional hydrocarbon processing from crude oil includes processes such as separation, conversion, and treatment. During the separation process, the liquids and vapors separate into petroleum components called fractions which separate based on their weight and boiling point in distillation units. Heavy fractions, such as asphalt and residual fuel oil, separate lower down in the distillation unit, while lighter fractions, such as gasoline and naphtha, vaporize and rise to the top. Once the fractions are separated, which may involve a multi-step process, the fractions are then further processed depending upon the fraction at issue, such as through cracking, alkylation, hydrocracking, unification, reforming, etc., to obtain higher-value products. These conversion processes may involve heat, pressure, catalysts, or some combination thereof. The results of these conversions are then treated to further purify or clean the fractions, or to mix fractions to produce a desired product.

By the nature of these processes, after each treatment or separation there is usually a primary desired component and at least one less desired component. To achieve separation of a primary desired component, subsequent refining processes may further involve separation of intermingled gaseous and liquid compositions. Such gas-liquid separations may produce heavy liquid or solid/liquid byproducts such as sludge. The term sludge refers to heavy hydrocarbons (C7-C9+) and accumulated sand and corrosion products. Similarly, safe and clean operation of many vessels involved in these processes, particularly pressurized vessels, may be intermittently subjected to blowdown to remove accumulated liquid components, which may be referred to as blowdown liquid stream or more generally as a blowdown feed.

Traditionally, undesired liquid portions from sludge and the blowdown liquid stream are considered not useful for further refining, and therefore, often are flared, burned, or otherwise disposed of, which may be considered to be less desirable from an environmental impact perspective. Nonetheless, these waste products often do contain at least some valuable hydrocarbon components. It would be advantageous to find a cost-effective solution that would allow such undesired products to be better utilized, either through incorporation into final products of commercial value or at least by decreasing the volume sent to flaring, burning, or similar disposal following a refining process.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

Some embodiments consistent with the present disclosure describe methods for treating a wet hydrocarbon sludge stream comprising: separating the wet hydrocarbon sludge stream into a gaseous separation stream, a first crude product stream, and a liquid separation stream using a separation vessel; separating the liquid separation stream into a surge drum gas stream, a first surge drum liquid stream, and a second surge drum liquid stream using a surge drum; separating the second surge drum liquid stream into a stripper gaseous stream and a stripper liquid stream using a stripper system; and separating the stripper liquid stream into an aqueous process stream and a primary crude product stream using a wet hydrocarbon separation vessel.

Other embodiments consistent with the present disclosure describe systems for treating a wet hydrocarbon streams comprising: a separation vessel, a surge drum, a stripper system, a wet hydrocarbon separation vessel, and a blowdown separation vessel; wherein, the blowdown separation vessel is configured to separate a blowdown stream into a blowdown gaseous stream and a blowdown liquid stream; the blowdown separation vessel is configured to (a) receive the blowdown liquid stream from the blowdown separation vessel, (b) receive a wet hydrocarbon sludge stream, and (b) separate a mixture of the blowdown stream and the wet hydrocarbon sludge stream into a gaseous separation stream, a first crude product stream, and a liquid separation stream; the surge drum is configured to receive and separate the liquid separation stream into a surge drum gas line, a first surge drum liquid stream, and a second surge drum liquid stream; the stripper system is configured to receive and separate the second surge drum liquid stream into stripper gaseous stream, and stripper liquid stream; and the wet hydrocarbon separation vessel is configured to receive and separate the stripper liquid stream into an aqueous process stream and a primary crude product stream.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
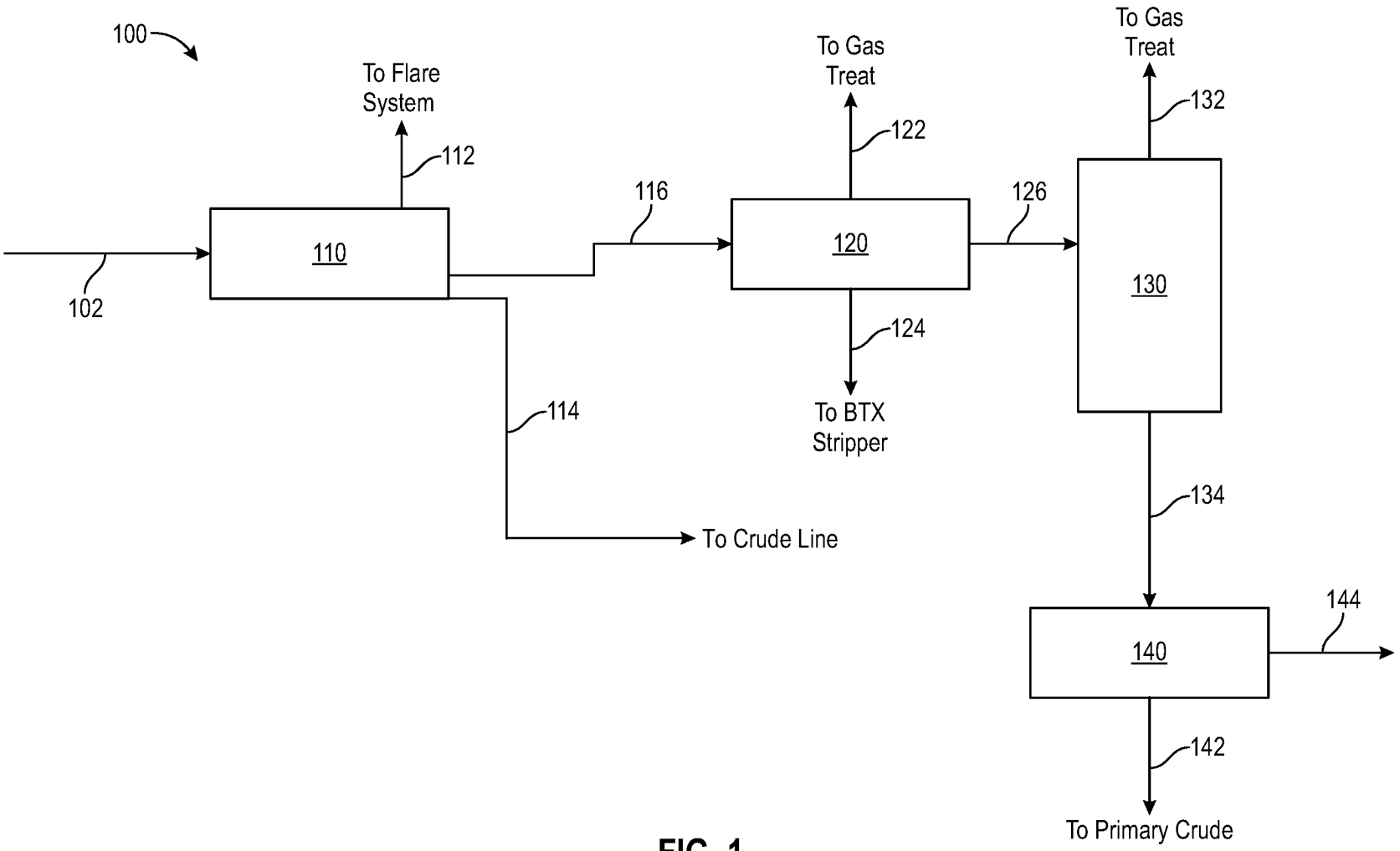
FIG. 1 is an illustrative example of a sludge treatment process described herein.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Figure 2:
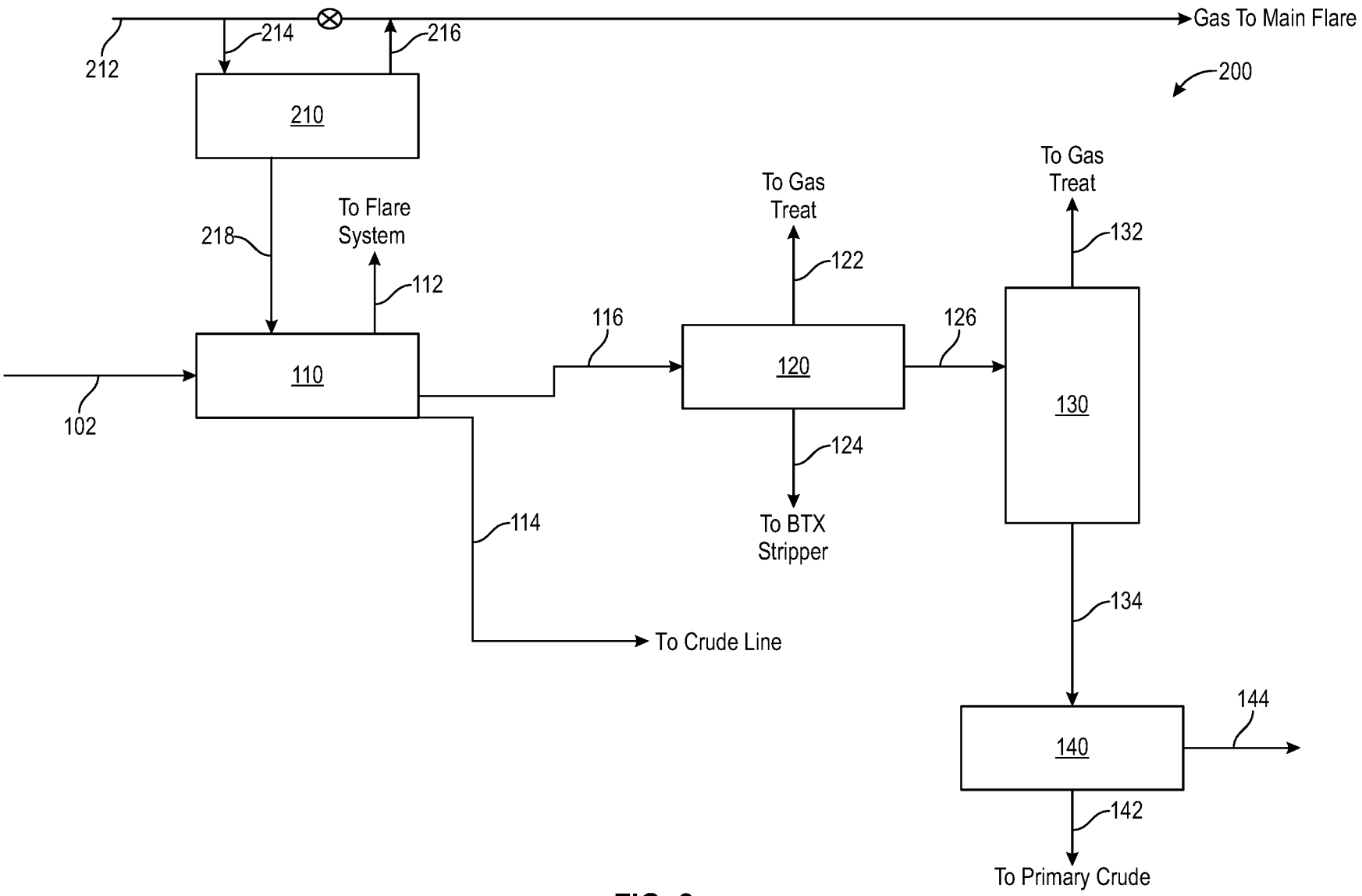
FIG. 2 is an illustrative example of a combined blowdown streams and sludge treatment process.

It should be understood that FIGS. 1 and 2 provide simplified schematic illustrations and description. The numerous valves, pumps, temperature sensors, electronic controllers, and the like that are customarily employed in refining operations and that are well known to those of ordinary skill in the art are not shown. The figures are not necessarily to scale and certain features and certain views of the figures may be shown exaggerated in scale for purposes of clarification. Wherever possible, like or identical reference numerals are used in the figures to identify common or the same elements.

The present disclosure relates generally to increasing refining efficiency and reducing waste and, more particularly, to recovery of usable hydrocarbons from sludge and/or blowdown feeds produced during hydrocarbon refining.

Hydrocarbon processing systems, such as those found in refineries, create waste products such as sludge and blowdown feeds that are generally flared or burned in an incinerator to eliminate waste products or reduce the waste products to a smaller volume of solid after-products. Although usually disposed of, the waste products often do contain at least some valuable hydrocarbon components. It would be desirable to create a processing framework that would both reduce the volume of material sent to the flare/burn process and to capture the valuable hydrocarbon components. When properly designed, such a system may reduce waste and carbon footprint and increase production of valuable hydrocarbon components.

In some embodiments, systems and processes are presented that utilize a plurality of liquid/gas separation vessels in combination with at least one surge drum and at least one stripper system to process wet hydrocarbon sludge streams into, for example, useful products, off-gas, and waste to be flared. The systems and processes associated therewith also create, for example, crude product streams, off-gas streams to be directed to further gas treatments, flare gas streams, and treated gas streams for further aromatic stripping processes, e.g., using a BTX (benzene-toluene-xylene) Stripper.

As described herein, surge drums may be used to separate liquid out of a gas stream such that the gas can be further processed or sent to a flare line. In either case, the surge drum removes the liquid from a mixed gas/liquid stream to create an outlet liquid stream and an outlet gas stream. Surge drums also may protect downstream gas processing operations or flares from surges to the line by greatly reducing the pressure between the total feed into the drum and a gas outlet from the drum. While this disclosure discusses the collection of wet hydrocarbon sludge/condensate, it should be noted that the invention would also apply to recovery of hydrocarbons from other sources otherwise considered waste, such as any intermittent liquid hydrocarbon recovery through the refining process.

As described herein, a BTX Stripper may be used to separate a mixture of aromatics into pure benzene, toluene, and mixed xylenes products. The product streams from the BTX Stripper may be sent for further processing into useful chemicals. The feedstock to the BTX unit is typically the reformate from a catalytic reforming unit (reformer) but can be any stream in which there are valuable aromatics to be recovered (e.g., first sludge drum liquid stream 124 of FIGS. 1-2). In the benzene column, benzene and remaining light paraffin and light naphthenes go overhead while toluene, mixed xylenes, ethyl benzene, and C9+ aromatics go out the bottom. The overhead may enter an absorber and a stripper unit to purify the benzene. The remaining paraffin and naphthenes enter a benzene recovery column where any remaining benzene is stripped out and recycled with the remaining impurities are sent on to further processing.

By way of example, a process 100 for treating wet hydrocarbon sludge is provided in FIG. 1. Preferably, wet hydrocarbon sludge stream 102 includes a significant portion that comprises a collection of sludge feeds from throughout the hydrocarbon processing facility. Wet hydrocarbon sludge stream 102 generally is 30-50 percent water and a mixture of hydrocarbons from C1 to C10. Wet hydrocarbon sludge stream 102 is first sent to separation vessel 110 wherein any volatile gases are removed and sent to a flare gas recovery system via gaseous separation stream 112. Separation vessel 110 can be a two-phase separator (commonly known as a slug-catcher) that acts to separate liquid hydrocarbons from aqueous process fluids. Preferably in certain embodiments of the process discussed herein, separation vessel 110 vessel has an operating pressure of between 125-175 psig and an operating temperature of between 100-150° F. (approx. 37-66° C.).

As used herein, separation vessels generally work using gravity to separate liquids and gases, and/or to separate hydrocarbon liquids from aqueous liquids. Separation vessels may also utilize mist extractors, counter-flow or change in direction, plate packs, matrix packs, heat, etc. Generally, horizontal separation vessels are preferred when separating liquids from gases and solids from liquids. Further, horizontal separation vessels avoid substantial counterflow and provide more surface area for separation. In certain embodiments, the separation vessels and surge drums described herein are preferably horizontal separation vessels to increase separation efficiency.

Also sometime removed from separation vessel 110 is a first crude product stream 114 that is sent to the crude line, and the remainder of the treated wet hydrocarbon sludge is removed via liquid separation stream 116 to surge drum 120. Exiting separation vessel 110, The majority of the lighter hydrocarbons (C1-C3) exit via gaseous separation stream 112, whereas the majority of the heavier hydrocarbons and the water exit via liquid separation stream 116. Separation vessel 110 separates a liquid steam 116 for further treatment and gas steam 112 for recovery in a flare gas recovery system. Under normal operation, little or no material exits via first crude product line 114. Surge drum 120 is a three-phase separator that acts to separate the liquid separation stream 116 into components including a gaseous stream 122, a liquid hydrocarbon stream that is sent on to stripper 130, and an aqueous process stream that comprises primarily sour water that is sent to BTX for treatment. Preferably in certain embodiments of the process discussed herein, surge drum 120 operates at an operating pressure of between 220-300 psig and an operating temperature of about 100-150° F. (approx. 37-66° C.).

The gaseous stream formed in surge drum 120 from liquid stream 116 exits via surge drum gas stream 122 and can be sent for further processing in a gas treatment unit, described further below. Surge drum gas stream 122 removes remaining lighter hydrocarbons (C1-C3) for further gas treatment. The gas treatment unit acts to absorb hydrogen sulfide and carbon dioxide from the gaseous stream to produce acid gas and sweet gas. Also, at least two liquid streams are produced at surge drum 120. They exit surge drum 120 as first surge drum liquid stream 124 which is primarily water and which can be sent for further processing via a BTX Stripper. The other liquid stream exits through second surge drum liquid stream 126 contains very little water and the remaining heavier hydrocarbons (C4+) and residual lighter hydrocarbons (C1-C3), that can be sent for further processing in stripper system 130. The gas treatment unit utilizes a solvent based system, preferably an amine solvent, with a closed loop circulation to absorb $H_2S$ (hydrogen sulfide) and $CO_2$ (carbon dioxide) from the gaseous stream to produce acid gas and sweet gas, both of which may be further processed.

Stripper system 130 acts to strip $H_2S$ and light gases and generate stabilized hydrocarbon condensate from second surge drum liquid stream 126. Preferably in certain embodiments of the process discussed herein, stripper system 130 has an operating pressure of about 200-250 psig and an operating temperature of about 200-250° F. (approx. 93-121° C.). The $H_2S$ and light gases exit stripper system 130 through a stripper gaseous stream 132, which is then sent to the Gas Treatment Unit described above. Stripper gaseous stream 132 comprises primarily the remaining light hydrocarbons (C1-C3) not previously removed. Also exiting stripper system 130 is stripper liquid stream 134 that is sent to wet hydrocarbon separation vessel 140. Stripper liquid stream 134 is primarily heavier hydrocarbons (C4+) for further processing.

As used herein, stripper systems refer to systems that may be used to separate sour components, generally sulfur-based compounds, from hydrocarbon streams to recover valuable hydrocarbons relatively free from sulfur components. In particular, condensate stripper systems separate the sulfur-based compounds from condensate streams that are generally collected from throughout the hydrocarbon processing system. However, the general function and purpose of a stripper system is the same whether it is used to treat condensate streams or, for instance, blowdown sludge.

In effect, in certain embodiments, the combination of surge drum 120 and stripper system 130 act to remove water and light ends from the hydrocarbon sludge stream 102 to meet crude quality specifications. In general crude specifications include below 2% water, basic sediment and water (BS&W) below 0.2%, and salts below 10 pound of salt/1000 barrel of crude).

Wet hydrocarbon separation vessel 140 represents the final processing step in process 100 for treating wet hydrocarbon sludge stream 102 and involves using a two-phase separator to separate the incoming stream 134 into a liquid hydrocarbon stream 142 and an aqueous process stream 144. During normal operation, aqueous process stream 144 may be very low or even no flow. Liquid hydrocarbon stream 142 contains very little or no water and consists primarily of C3+ hydrocarbons. desirable hydrocarbons recovered through system 100. Preferably in certain embodiments of the process discussed herein, wet hydrocarbon separation vessel 140 has an operating pressure of about 150-200 psig and 100-130° F. (approx. 37-55° C.). Aqueous process stream 144 can be recovered through a Flare Gas Recovery System, not shown, and primary crude product stream 142 can be optimally sent to be blended, and further processed as needed, with the primary crude product(s). This system may reduce waste and carbon footprint of the process as well as increase production of valuable hydrocarbon components.

Referring to FIG. 2, in addition to treating wet hydrocarbon sludge, the same basic components of process 100, including separation vessel 110, surge drum 120, stripper system 130, and wet hydrocarbon separation vessel 140, can also be used to recover useful hydrocarbons from blowdown streams (that may or may not be combined with sludge streams) from across the processing facility.

As shown in FIG. 2, the blowdown streams from a variety of vessels may be collected into a blowdown header 212. Instead of flaring or otherwise disposing of the collected blowdown streams in blowdown header 212, according to embodiments described herein, the contents of blowdown header 212 may be recovered at least in part by using system 100 described above in FIG. 1. The blowdown streams may be combined with wet hydrocarbon sludge streams, such as wet hydrocarbon sludge stream 102, as described above in reference to FIG. 1. Of course, while a general facility or portion of facility blowdown header 212 is shown here, it should be understood that more localized sources of blowdown may also be directed to process 100 described in FIG. 1. Moreover, as an alternative, individual blowdown streams may be directed fed to process 100 without being collected in a common blowdown header 212 prior to that or as depicted in FIG. 2.

FIG. 2 shows that at least a portion of the contents of the blowdown header 212 may be sent to blowdown separation vessel 210 through blowdown stream 214. In blowdown separation vessel 210, blowdown gaseous stream 216 is separated from blowdown stream 214 and then returned to the blowdown header 212. Recovered stream 218 may be sent to a separation vessel, such as separation vessel 110 as shown FIG. 2, to be processed and treated in process 100 as described above. During normal operation, recovered stream 218 is primarily water with some residual hydrocarbons, generally C5+.

It is to be further understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

The invention claimed is:

1. A method for treating a wet hydrocarbon sludge stream comprising:

separating the wet hydrocarbon sludge stream into a gaseous separation stream, a first crude product stream, and a liquid separation stream using a separation vessel;

processing the gaseous separation stream in a flare gas recovery system;

separating the liquid separation stream into a surge drum gas stream, a first surge drum liquid stream, and a second surge drum liquid stream using a surge drum; wherein, the surge drum is a three-phase separator that acts to separate the surge drum gas stream, the first surge drum liquid stream, and the second surge drum liquid stream, wherein the first surge drum liquid stream comprises water and the second surge drum liquid stream comprises C4+hydrocarbons, and wherein the surge drum is at an operating pressure of between 220-300 psig and an operating temperature of between 100-150° F.;

separating the second surge drum liquid stream into a stripper gaseous stream and a stripper liquid stream using a stripper system wherein the stripper system is at an operating pressure of between 200-250 psig and an operating temperature of between 200-250° F.;

processing the surge drum gas stream and the stripper gaseous stream in a gas treatment unit utilizing a solvent; and separating the stripper liquid stream into an aqueous process stream and a primary crude product stream using a wet hydrocarbon separation vessel.

2. The method of claim 1 further comprising:

separating a blowdown stream into a blowdown gaseous stream and a blowdown liquid stream using a blowdown separation vessel and sending the blowdown liquid stream to the separation vessel.

3. The method of claim 1, wherein the combination of the surge drum and the stripper system act to remove water and light ends from the wet hydrocarbon sludge stream to meet crude quality specifications.

4. The method of claim 1 further comprising:

blending the primary crude product stream and the first crude product stream.

5. The method of claim 1, wherein the separation vessel is at an operating pressure of between 125-175 psig and an operating temperature of between 100-150 ° F.

6. The method of claim 1, wherein the wet hydrocarbon separation vessel is a two-phase separator that acts to separate liquid hydrocarbons from aqueous fluids.

7. The method of claim 6, wherein the wet hydrocarbon separation vessel is at an operating pressure of between 150-200 psig and an operating temperature of between 100-130° F.

8. The method of claim 1, wherein the solvent comprises an amine solvent.

* * * * *